US011812841B2

(12) United States Patent
Lee

(10) Patent No.: US 11,812,841 B2
(45) Date of Patent: Nov. 14, 2023

(54) COSMETIC CONTAINER WITH CONTENTS VISIBLE FROM OUTSIDE

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 533 days.

(21) Appl. No.: 17/091,457

(22) Filed: Nov. 6, 2020

(65) Prior Publication Data

US 2021/0267352 A1 Sep. 2, 2021

(30) Foreign Application Priority Data

Feb. 28, 2020 (KR) ..... 10-2020-0025411

(51) Int. Cl.
*A45D 40/22* (2006.01)

(52) U.S. Cl.
CPC ..... *A45D 40/222* (2013.01); *A45D 2040/223* (2013.01); *A45D 2200/053* (2013.01)

(58) Field of Classification Search
CPC ..... B65D 77/04; B65D 43/16; A45D 33/22; A45D 34/00; A45D 220/223; A45D 40/0222
USPC ..... 206/581
See application file for complete search history.

(56) References Cited

U.S. PATENT DOCUMENTS

| | | | | |
|---|---|---|---|---|
| 5,431,177 | A * | 7/1995 | Kecman | A45C 11/00 D28/78 |
| 5,704,378 | A * | 1/1998 | Machelett | A45C 13/005 206/823 |
| 9,936,791 | B2 * | 4/2018 | Kim | A45D 40/0075 |
| 10,986,910 | B2 * | 4/2021 | Kim | A45D 42/02 |
| 11,478,060 | B2 * | 10/2022 | Yan | A45D 33/32 |
| 2014/0261530 | A1 * | 9/2014 | McNamara | A45D 40/00 132/286 |
| 2014/0283870 | A1 * | 9/2014 | Byeon | A45D 33/006 132/315 |
| 2015/0320174 | A1 * | 11/2015 | Kim | A47G 19/00 132/295 |
| 2016/0353857 | A1 * | 12/2016 | Kim | A45D 40/22 |
| 2017/0013939 | A1 * | 1/2017 | Choi | A45D 33/025 |
| 2017/0303662 | A1 * | 10/2017 | Jeong | B65D 43/164 |

(Continued)

FOREIGN PATENT DOCUMENTS

| | | | |
|---|---|---|---|
| KR | 101584512 | B1 | 1/2016 |
| KR | 101684243 | B1 | 6/2016 |

*Primary Examiner* — Ernesto A Grano
(74) *Attorney, Agent, or Firm* — Heedong Chae; Lucem, PC

(57) ABSTRACT

A cosmetic container with contents visible from an outside according to one aspect of the present disclosure includes a container body provided at one side thereof with a first locking hook and formed of a transparent material; a container lid for opening and closing the container body; a content container mounted in the container body, receiving the contents therein, and formed of a transparent material; a content container lid for opening and closing the content container; a push button installed on the container lid so as to be press-operated and provided with a second locking hook; and a button coupling member coupled to an inside of the container lid to fix the push button and hingedly coupled to the container body.

6 Claims, 8 Drawing Sheets

(56) References Cited

U.S. PATENT DOCUMENTS

| | | | | |
|---|---|---|---|---|
| 2017/0318939 | A1* | 11/2017 | Kim | A45D 40/222 |
| 2017/0320646 | A1* | 11/2017 | Kim | A45D 40/22 |
| 2018/0098613 | A1* | 4/2018 | Kim | B65D 47/06 |
| 2018/0110316 | A1* | 4/2018 | Kim | A45D 40/26 |
| 2018/0271255 | A1* | 9/2018 | Hong | A45D 33/006 |
| 2019/0166975 | A1* | 6/2019 | Hong | B65D 53/02 |
| 2020/0397120 | A1* | 12/2020 | Jeong | A45D 34/00 |

* cited by examiner

COSMETIC CONTAINER WITH CONTENTS VISIBLE FROM OUTSIDE

BACKGROUND

1. Field of the Invention

One aspect of the present disclosure relates to a cosmetic container with contents visible from an outside, and more particularly, to a cosmetic container with contents visible from an outside, in which the contents contained in a content container are reflected to the outside so that a user can easily check the contents without opening a container lid, aesthetics of the cosmetic container can be improved, and a push button installed on the container lid can be stably operated.

2. Description of the Related Art

Cosmetics are products used to beautify an external appearance of a human body to cover defects in appearance, make the appearance attractive, or maintain health of skin and hair.

The cosmetics are classified into basic cosmetics, color cosmetics, and functional cosmetics depending on the purpose of use. The cosmetics are manufactured in liquid or gel form, or solid or powder form according to characteristics thereof, and stored and used in various cosmetic containers.

Accordingly, there is a need to develop containers for various types of cosmetics according to the purpose of use and characteristics of the cosmetics. In general, liquid-type or gel-type cosmetics are used are filled in a glass container or a tube container and a user takes some cosmetics on hands in use or squeezes the cosmetics from the container and applies the cosmetics on a skin by using a puff.

However, according to the conventional cosmetic container, since the user gets cosmetics on the hand whenever using the cosmetics, it is inconvenient for use because the user needs to wash hands every time after use and the cosmetics are wasted.

In order to solve the above problems, a compact container with a built-in puff has been developed so that it is not necessary to get a cosmetic material on the hand and it is easy to carry the cosmetic container.

Such a conventional compact container is disclosed in Korean Patent Registration No. 10-1584512. The conventional compact container includes an outer container, a refill container coupled to an inner side of the outer container to contain a cosmetic material therein, a refill container lid to open or close the refill container, and an outer container lid that opens and closes the outer container, in which the outer container and the refill container are undercut coupled so that they are detachable. Thus, when the cosmetic material contained in the refill container is completely used, the refill container can be removed from the outer container so that a new refill container is coupled to the outer container.

However, the conventional compact container is inconvenient in use in that the outer container lid and the refill container lid need to be opened from the outer container and the refill container, respectively, in order to check the type and color of the cosmetic material contained in the refill container.

In addition, since the conventional compact container has a push button installed on the front of the outer container, even when both the outer container and the refill container are formed of a transparent material so that the cosmetic material contained in the refill container is reflected to the outside, a part of the outer container is blocked by the push button, which interferes with checking the type and color of the cosmetics, and the push button installed on the outer container occupies a predetermined space inside the outer container, thereby reducing the space for storing the cosmetics.

In order to solve the above problem, Korean Patent Registration No. 10-1684243 has been disclosed, which relates to a compact container for cosmetics having an opening and closing button on a lid, and in which a storage space for the opening and closing button in a container body is removed by forming the opening and closing button on the container lid, and a main container required for assembling the opening and closing button is improved to maximize the storage space for the cosmetic materials in the container body, so that a lot of cosmetic materials can be effectively filled, thereby eliminating the need for frequently filling the cosmetic materials.

However, according to the above related art, since the opening and closing button is directly coupled to one side of the container lid through a shaft, there is a problem that the opening and closing button may be separated from the container lid or may be damaged by an external impact and there is an inconvenience in use because the opening and closing button is wobbled and shaken as the container lid is opened.

Therefore, it is necessary to develop a cosmetic container, in which cosmetic materials contained the cosmetic container can be easily checked without the interference of a push button and without opening an outer container lid and a refill container lid, and the push button is stably and fixedly coupled so that there is no inconvenience in use.

DOCUMENTS OF RELATED ART

Patent Documents (Patent Document 0001) Korean Patent Registration No. 10-1584512 (issued on Jan. 25, 2016)

(Patent Document 0002) Korean Patent Registration No. 10-1684243 (issued on Dec. 9, 2016)

SUMMARY

In order to solve the above problems, an object of the present disclosure is to provide a cosmetic container with contents visible from an outside, in which a content container for storing the contents therein and a container body surrounding the content container are formed of a transparent material, and a push button is formed on a container lid that opens and closes the container body, so that the contents are visible from the outside and a user can easily check the contents without opening the container lid, thereby improving the beauty of the external appearance.

In addition, another object of the present disclosure is to provide a cosmetic container with contents visible from an outside, in which a push button is installed inside a container lid by a button coupling member such that at least a portion of the push button is exposed to the outside of the container lid, and the container lid is hingedly coupled to a container body by the button coupling member, so that the push button is stably moved back and forth to improve durability, and the push button is prevented from shaking when the container lid is opened and closed, thereby improving the convenience in use.

In order to achieve the above objects, the present disclosure provides a cosmetic container with contents visible from an outside, in which the cosmetic container includes:

a container body provided at one side thereof with a first locking hook and formed of a transparent material; a container lid for opening and closing the container body; a content container mounted in the container body, receiving the contents therein, and formed of a transparent material; a content container lid for opening and closing the content container; a push button installed on the container lid so as to be press-operated and provided with a second locking hook; and a button coupling member coupled to an inside of the container lid to fix the push button and hingedly coupled to the container body.

In addition, a body coupling ring having the first locking hook and a first hinge portion may be coupled to the container body, and the body coupling ring may be bonded to an upper end of the container body.

Further, a button through hole may be formed in one side of the container lid, and at least a portion of the push button may pass through the button through hole.

In addition, a content container coupling ring may be coupled to an upper end of the content container, first and second lower extension protrusion rings that are coupled while surrounding an upper end of an outer wall of the content container may extend from a lower side of the content container coupling ring, and a third lower extension protrusion ring may be provided in close contact with a sealing protrusion ring formed on the content container lid while being inwardly spaced from the first and second lower extension protrusion rings.

Further, the push button may include a push portion exposed to an outside of the container lid, a locking portion inserted into an inside of the container lid and having a hook insertion hole and the second locking hook, and elastic blades extending both sides of the locking portion to provide elasticity to the push portion and the locking portion.

In addition, a button insertion hole may be formed in the button coupling member such that at least a portion of the push button is inserted into the button insertion hole, and a second hinge portion may be formed on the button coupling member and hingedly coupled with the first hinge portion formed on the container body.

Further, a mirror may be formed on an inside of the container lid, the button coupling member may have a ring shape with a predetermined width, and the button coupling member may be coupled to an inside of the container lid while pressing an edge portion of the mirror.

According to one aspect of the present disclosure, a content container for storing the contents therein and a container body surrounding the content container are formed of a transparent material, and a push button is formed on a container lid that opens and closes the container body, so that the contents are visible from the outside and a user can easily check the contents without opening the container lid, thereby improving the beauty of the external appearance.

In addition, according to one aspect of the present disclosure, a push button is installed inside a container lid by a button coupling member such that at least a portion of the push button is exposed to the outside of the container lid, and the container lid is hingedly coupled to a container body by the button coupling member, so that the push button can be stably moved back and forth to improve durability, and the push button can be prevented from shaking when the container lid is opened and closed, thereby improving the convenience in use.

DETAILED DESCRIPTION OF THE EMBODIMENTS

Figure 1:
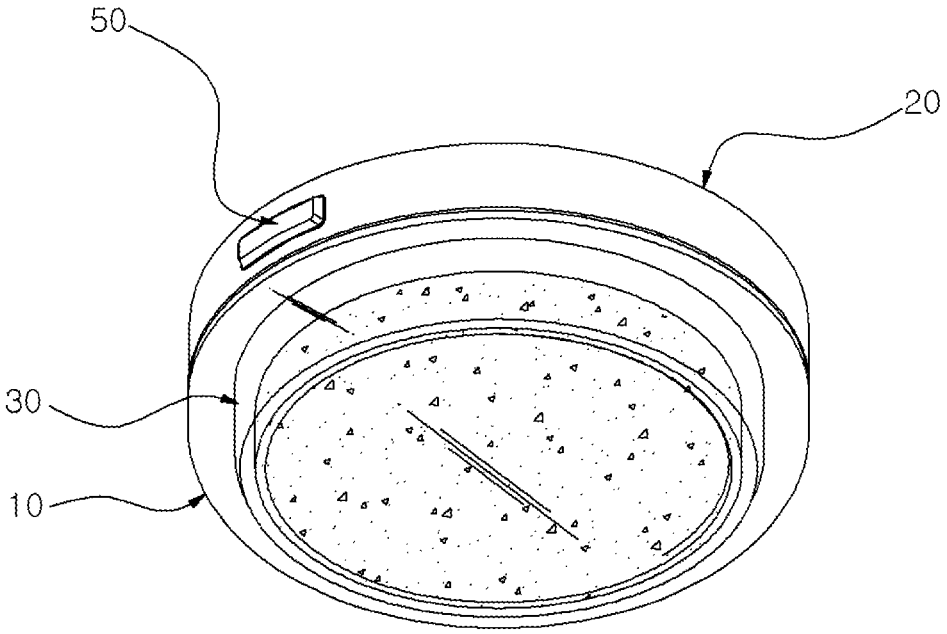
FIG. 1 is a perspective view of a cosmetic container according to one aspect of the present disclosure.

Reference will now be made in detail to the embodiments of the present disclosure, examples of which are illustrated in the accompanying drawings. These embodiments are described insufficient detail to enable those skilled in the art to practice the disclosure. It should be understood that the various embodiments of the present disclosure are different, but need not be mutually exclusive. For example, certain features, structures, and characteristics described herein may be implemented in other embodiments without departing from the spirit and scope of the present disclosure in connection with an embodiment. It is also to be understood that the position or arrangement of the individual components within each described embodiment may be varied without departing from the spirit and scope of the present disclosure.

Therefore, the following detailed description is not to be taken in a limiting sense, and the scope of the present disclosure is to be defined only by the appended claims and includes the scope of equivalents of the claimed disclosure. In the drawings, like reference numerals refer to the same or similar functions throughout various aspects.

With respect to the terms used in the present disclosure, general terms that are currently and widely used are selected in consideration of functions of the present disclosure. However, the meanings of the terms may be changed according to intention of those skilled in the art, a judicial precedent, emergence of a new technology, and the like. In addition, in certain cases, a term may be selected at discretion of the applicant. In such cases, the meaning of the term will be described in detail at the corresponding part in the description of the present disclosure. Therefore, the terms used in the present disclosure should be defined based on the meanings of the terms and the entire descriptions provided herein without being simply limited to the names of terms.

Throughout the description of the present disclosure, when some part "includes" some elements, unless explicitly described to the contrary, it means that other elements may be further included but not excluded.

Hereinafter, a cosmetic container with contents visible from an outside according to one aspect of the present disclosure will be described in detail with reference to FIGS. 1 to 8.

Figure 2:
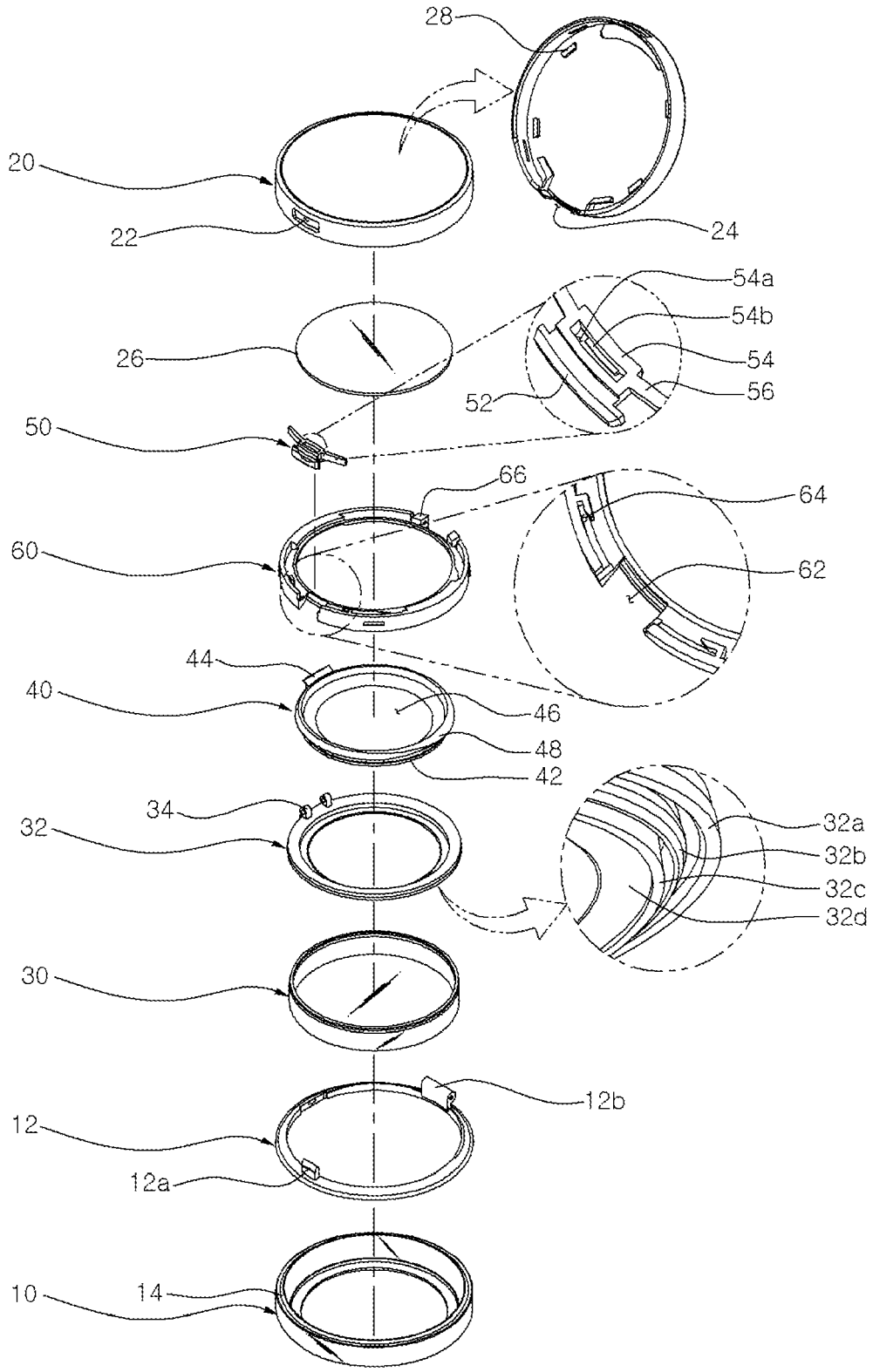
FIG. 2 is an exploded perspective view of a cosmetic container according to one aspect of the present disclosure.
Figure 3:
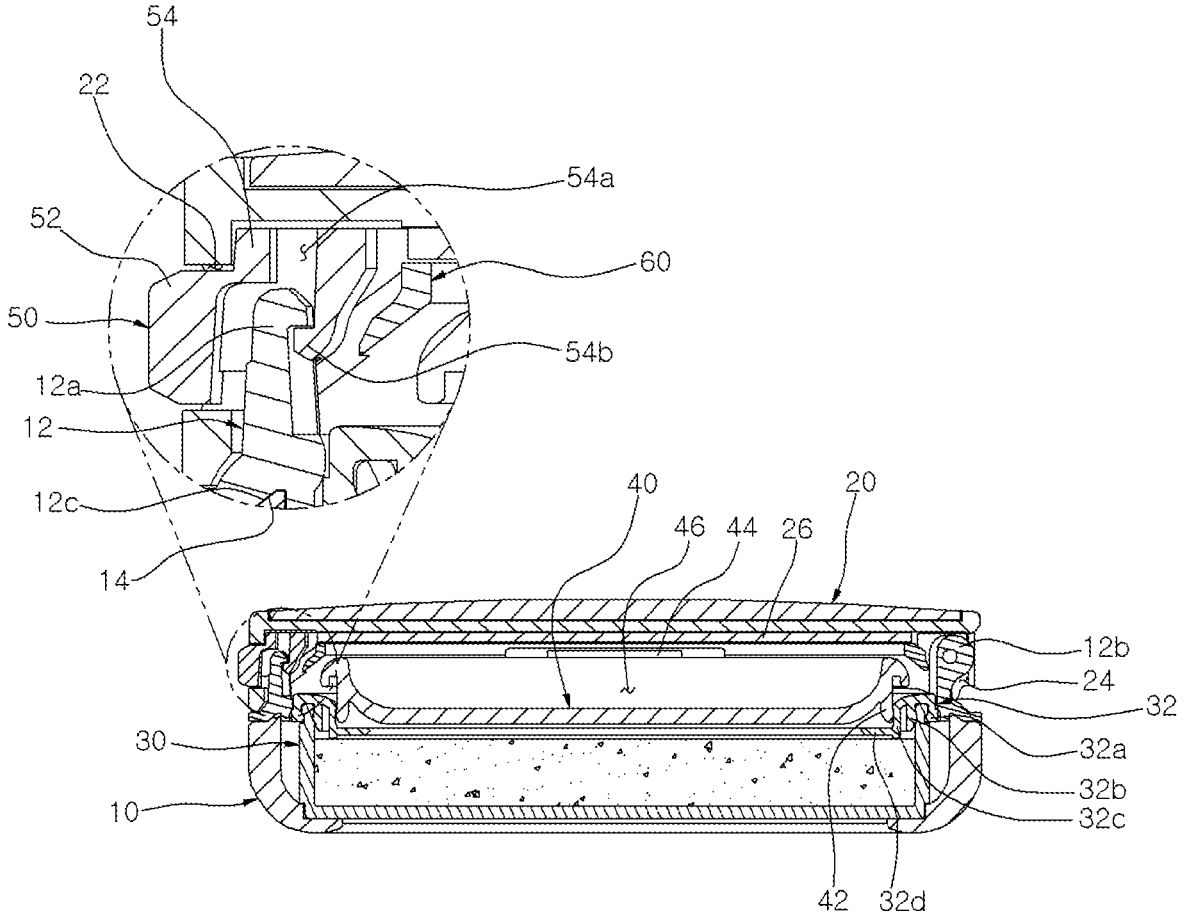
FIG. 3 is a sectional view of a cosmetic container according to one aspect of the present disclosure.
Figure 4:
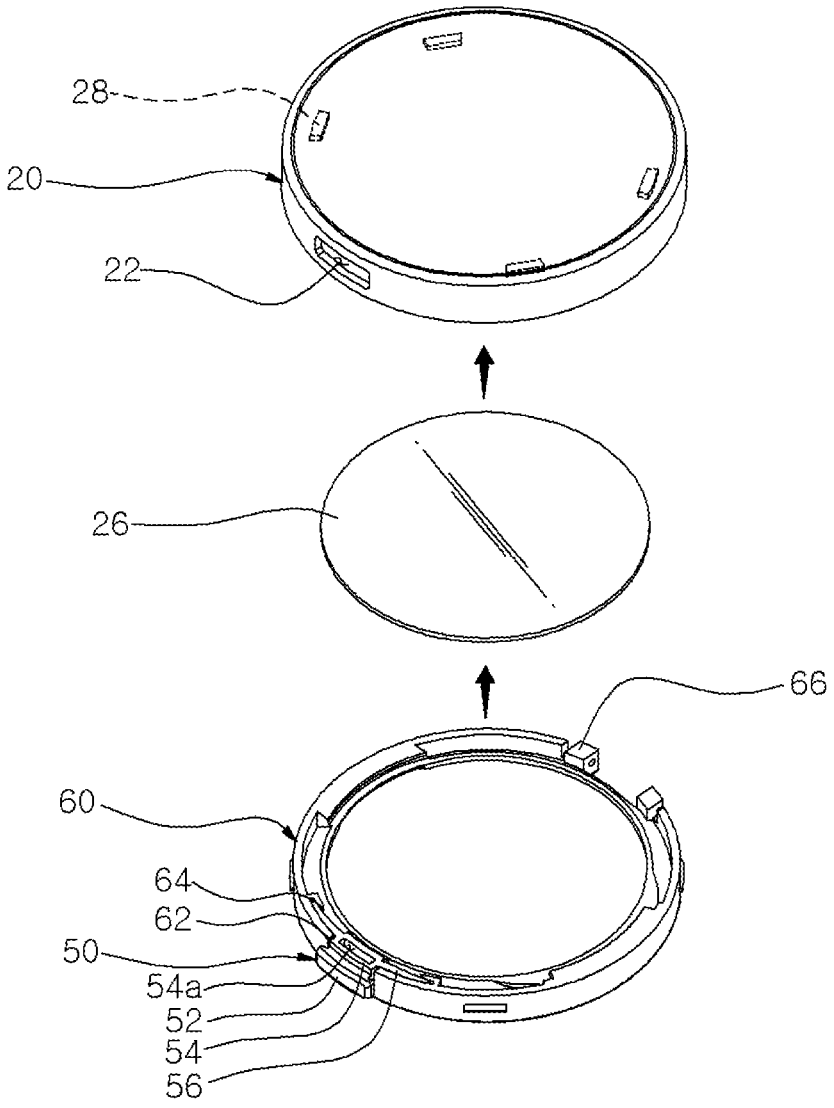
FIG. 4 is a perspective view illustrating a state in which a button coupling member into which a pushbutton is inserted is coupled to an inside of a container lid according to one aspect of the present disclosure.

FIG. 1 is a perspective view of a cosmetic container according to one aspect of the present disclosure, FIG. 2 is an exploded perspective view of a cosmetic container according to one aspect of the present disclosure, FIG. 3 is a sectional view of a cosmetic container according to one aspect of the present disclosure, and FIG. 4 is a perspective view illustrating a state in which a button coupling member into which a push button is inserted is coupled to an inside of a container lid according to one aspect of the present disclosure.

As shown in the drawings, the present disclosure may include a container body 10, a container lid 20, a content container 30, a content container lid 40, a push button 50, and a button coupling member 60.

The container body 10 may have a cylindrical shape with opened upper and lower portions, and the content container 30 may be inserted into the container body 10 through the opened upper portion, and the bottom of the content container 30 may be exposed to the outside through the opened lower portion. In the drawing of the cosmetic container according to one aspect of the present disclosure, the container body 10 is illustrated in a cylindrical shape with a low height and a wide width, but the present disclosure is not limited thereto, and may be modified in various forms according to convenience of use or the preference or fashion of a purchaser.

As shown in FIGS. 1 and 2, the container body 10 may be provided at one side thereof with a first locking hook 12*a* protruding upward and coupled to the container lid 20. In addition, a surface of the container body 10 may be formed of a transparent material so that the content container 30 mounted in the container body 10 may be reflected to the outside, so that the user can easily check the inside of the container body 10 from the outside.

Further, a ring-shaped body coupling ring 12 may be provided on an upper end of the container body 10. The body coupling ring 12 may be provided at one side thereof with a first locking hook 12*a* that protrudes upward and is coupled with the container lid 20, and a first hinge portion 12*b* may be provided in opposition to the first locking hook 12*a* so that the first hinge portion 12*b* may be coupled to the button coupling member 60 to be described below.

The body coupling ring 12 may be bonded to an end of an outer wall of the container body 10 through ultrasonic bonding, high-frequency bonding, or thermal bonding. This is to prevent the aesthetic feeling of the cosmetic container from being degraded due to the coupling structure when the container body 10 and the body coupling ring 12 have separate coupling structures.

Meanwhile, a bonding protrusion 14 may protrude from an upper end of the container body 10, and a bonding groove 12*c* may be formed at a lower end of the body coupling ring 12 such that the container body 10 and the body coupling ring 12 can be bonded to each other in a state in which they are fitted with each other.

The container lid 20 may have a cylindrical shape with an opened lower portion, and may open and close the container body 10 while rotating.

As shown in FIG. 2, a button through hole 22 may be formed at one side of the container lid 20 so that at least a portion of the push button 50 may pass through the button through hole 22, and a hinge insertion hole 24 may be formed in opposition to the button through hole 22 so that the first hinge portion 12*b* of the container body 10 may be inserted into the hinge insertion hole 24.

In addition, a mirror 26 may be fixedly inserted into an inside of the container lid 20 so that the user can easily perform the makeup while viewing the makeup area. Meanwhile, at least one positioning protrusion 28 may be provided on an inner upper surface of the container lid 20. The positioning protrusion 28 may be arranged in the form of a circle along an edge of the container lid 20 and adhered to an outer surface of the mirror 26 so that the mirror 26 can be fixedly positioned at an inner center of the container lid 20.

The content container 30 may be mounted in the container body while being inserted into the container body 10 through the opened upper portion of the container body 10.

The contents or an impregnation member impregnated with the contents may be contained in the content container 30, and the impregnation member may be formed of a material including at least one of BR (Butadiene Rubber), SBR (Styrene Butadiene Rubber), NR (Natural Rubber), NRSBR (Natural Rubber Styrene Butadiene Rubber), NBR (acrylonitrile-butadiene rubber), wet urethane, dry urethane, polyether, polyester, polyvinyl chloride, polyethylene, latex, silicone, PVA (PolyVinyl Alcohol), nitrile rubber, butyl rubber and neoprene.

As shown in FIGS. 1 and 2, the content container 30 may have a surface formed of a transparent material so that the contents contained in the content container 30 may be reflected to the outside, thereby allowing the user to easily check the inside of the content container 30.

Meanwhile, the container body 10 and the content container 30 may adjust the transparency (a value expressed as a ratio of light transmitted through a mineral) for improving the information delivery function or aesthetics. For example, the contents contained in the container body 10 and the container body 10 can be clearly visible through the container body 10 and the container body 10 by increasing the transparency of the container body 10 and the container body 30, the contents contained in the container body 10 and the container body 10 can be delicately visible through the content container 30 and the container body 10 by lowering the transparency.

In addition, a ring-shaped content container coupling ring 32 may be coupled to an upper end of the content container 30, in which the content container coupling ring 32 may seal the inside of the content container 30 and may allow the content container 30 to be coupled to the content container lid 40.

First and second lower extension protrusion rings 32*a* and 32*b* may vertically extend from a lower portion of an edge of the content container coupling ring 32, and a third lower extension protrusion ring 32*c* may vertically extend while being inwardly spaced apart from the first and second lower extension protrusion rings 32*a* and 32*b*. As shown in FIG. 3, the first and second lower extension protrusion rings 32*a* and 32*b* may be coupled while surrounding an upper end of an outer wall of the content container 30, and the third lower extension protrusion ring 32*c* may come into close contact with a sealing protrusion ring 42 of the content container lid 40 to seal the inside of the content container 30 when the content container lid 40 is closed. Further, a horizontal extension protrusion ring 32*d* may horizontally extend to the inside of the third lower extension protrusion ring 32*c*, in which the horizontal extension protrusion ring 32*d* may limit an exposed portion of the impregnation member contained in the content container 30 or prevent the impregnation member from going to the outside.

In addition, a first hinge coupling portion 34 may protrude from one side of an upper portion of the content container coupling ring 32 so as to be hingedly coupled with the content container lid 40.

The content container lid 40 may be hingedly coupled with the content container 30 and rotate to open and close the content container 30.

A sealing protrusion ring 42 may extend downward from a lower portion of the content container lid 40. The sealing protrusion ring 42 may come into close contact with an inner peripheral surface of the third lower extension protrusion ring 32*c* of the content container when the content container lid 40 is closed and may be formed at an upper portion thereof with a cosmetic tool storage groove 46 to store cosmetic tools (not shown).

In addition, as shown in FIG. 2, a second hinge coupling portion 44 may be provided on one side of the content container lid 40 so as to be hingedly coupled with the first hinge coupling portion 34 of the content container 30, and a knob 48 may be provided in opposition to the second hinge coupling portion 44, in which the knob 48 protrude outward to allow a user to easily hold the knob 48.

The push button 50 may move forward and backward as the user presses the push button 50, thereby releasing the container body 10 from the container lid 20. In other words, the push button 50 is installed inside the container lid 20 by the button coupling member 60, and at least a portion of the push button 50 is exposed to the outside of the container lid 20 such that the user can press the push button 50.

As shown in FIG. 2, the push button 50 may include a push portion 52 exposed to the outside of the container lid 20, a locking portion 54 inserted into the inside of the container lid 20 and having a hook insertion hole 54*a* and a second locking hook 54*b*, and elastic blades 56 extending from both sides of the locking portion 54 to provide elasticity to the push portion 52 and the locking portion 54.

The push portion 52 may be a part that the user directly presses to move the locking portion 54 rearward by a predetermined distance, and the push portion 52 may protrude outward from the container lid by passing through a button through hole 22 of the container lid 20. An outer surface of the push portion 52 may be formed in a curved shape corresponding to the outer peripheral surface of the container lid 20.

The locking portion 54 may be provided at the rear of the push portion 52 and move forward and backward according to the pressing operation of the push portion 52 so as to be fastened to or released from the first locking hook 12*a* of the container body 10. The coupling portion 54 may be formed at the center thereof with the hook insertion hole 54*a*, in which the first locking hook 12*a* is inserted into a lower portion of the hook insertion hole 54*a*, and the second locking hook 54*a* coupled with the first locking hook 12*a* may provide from the inside of the hook insertion hole 54*a*. The second locking hook 54*b* may protrude in a direction facing a protrusion protruding from a side of the first locking hook 12*a* such that the first locking hook 12*a* and the second locking hook 54*b* can be undercut coupled with each other.

The elastic blades 56 may extend from both sides of the locking portion 54. The elastic blades 56 may be inserted into elastic blade insertion grooves 64 formed in the button coupling member 60 and bent according to the pressing operation of the push portion 52, thereby providing elasticity to the push portion 52 and the locking portion 54.

As described above, in the cosmetic container according to one aspect of the present disclosure, the content container 30 in which the contents are accommodated and the container body 10 surrounding the content container 30 are formed of a transparent material, and the push button 50 is installed on one side of the container lid 20, so that the contents are reflected to the outside even when the user does not open the container lid 20 and the contents reflected to the outside are not visually blocked by the push button 50. Thus, the contents contained in the content container 30 can be easily checked and the beauty of the external appearance can be improved.

The button coupling member 60 may be formed in a ring shape having a predetermined width and inserted into the inside of the container lid 20 so as to be coupled to the container lid 20, thereby fixing the push button 50 while being hingedly coupled with the container body 10.

The button coupling member 60 may be formed with the button insertion hole 62 into which the locking portion 54 of the pushbutton 50 is inserted, and the elastic blade insertion grooves 64 into which the elastic blades 56 of the push button 50 are inserted may be formed at both sides of the button insertion hole 62. In addition, the second hinge portion 66 hingedly coupled to the first hinge portion 12*b* provided in the container body 10 may be formed opposite to the button insertion grooves 62 of the button coupling member 60. That is, the push button 50 may be installed inside the container lid 20 by the button coupling member 60, and the container body 10 and the container lid 20 may be hingedly coupled with each other through the button coupling member 60.

As shown in FIG. 3, the button coupling member 60 may be fixedly coupled to the inside of the container lid 20 while pressing the edge portion of the mirror 26 formed on the container lid 20. That is, the button coupling member 60 may block the gap between the mirror 26 and the inner circumference of the container lid 20 while covering the edge of the mirror 26, thereby preventing the contents from entering the gap and becoming messy.

In the drawings of the cosmetic container according to one aspect of the present disclosure, the container lid 20 and the button coupling member 60 are illustrated as they are coupled to each other by a protrusion and a groove, but the present disclosure is not limited thereto and various coupling methods such as undercut coupling or press-fitting coupling may be adopted so far as the coupling member 60 can be firmly and fixedly coupled to the inside of the container lid 20.

Meanwhile, when assembling the push button 50 by using the button coupling member 60, as shown in FIG. 4, the locking portion 54 of the push button 50 is inserted into the button insertion hole 62 of the button coupling member 60, and at the same time, the elastic blades 56 of the push button 50 are inserted into the elastic blade insertion grooves 64 of the button coupling member 60, and the mirror 26 is fitted inside the positioning protrusion 28 of the container lid 20. Then, the button coupling member 60 is inserted into the inside of the container lid 20 and fixedly coupled by pressing the edge portion on the mirror 26.

In other words, the button coupling member 60 allows the push button 50 to be fixedly installed on the inside of the container lid and is hingedly coupled with the container body 10 to allow the container lid 20 to rotate. Thus, the conventional structure in which the push button is directly coupled to the container lid and the container lid is directly shaft-coupled to the container body can be modified by the button coupling member 60, thereby improving the durability and convenience of use of the cosmetic container.

In addition, since the push button 50 is installed on the inside of the container lid 20 while being supported by the button coupling member 60, the push button 50 can more stably move back and forth, so that the durability can be improved and the convenience of use can be enhanced because the push button 50 can be prevented from arbitrarily shaking when the container lid 20 is opened and closed.

FIGS. 5 to 8 are views illustrating the use of the cosmetic container according to one aspect of the present disclosure. Hereinafter, a method of using the cosmetic container according to one aspect of the present disclosure will be described with reference to FIGS. 5 to 8.

Figure 5:
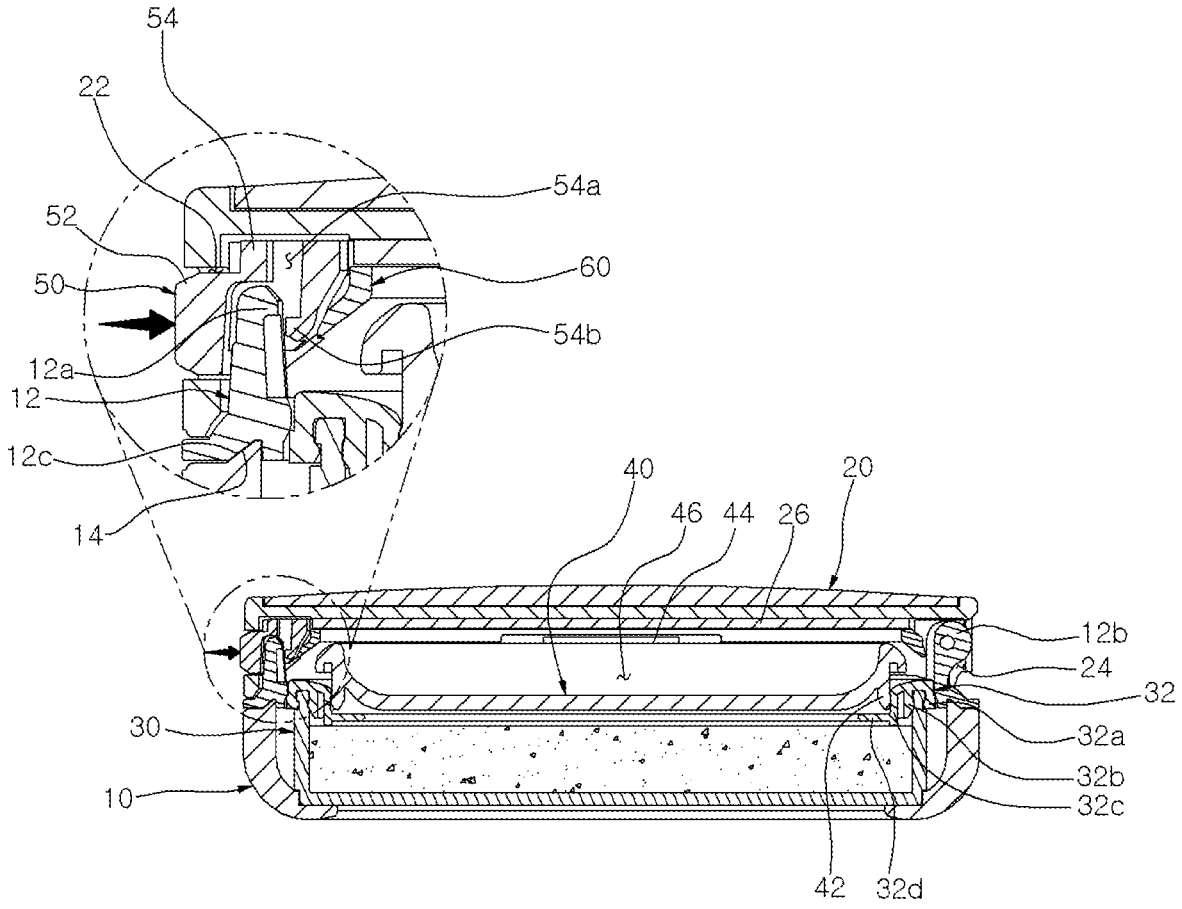
FIG. 5 is a sectional view illustrating a state in which a container body is released from a container lid by pressing a push button according to one aspect of the present disclosure.
Figure 6:
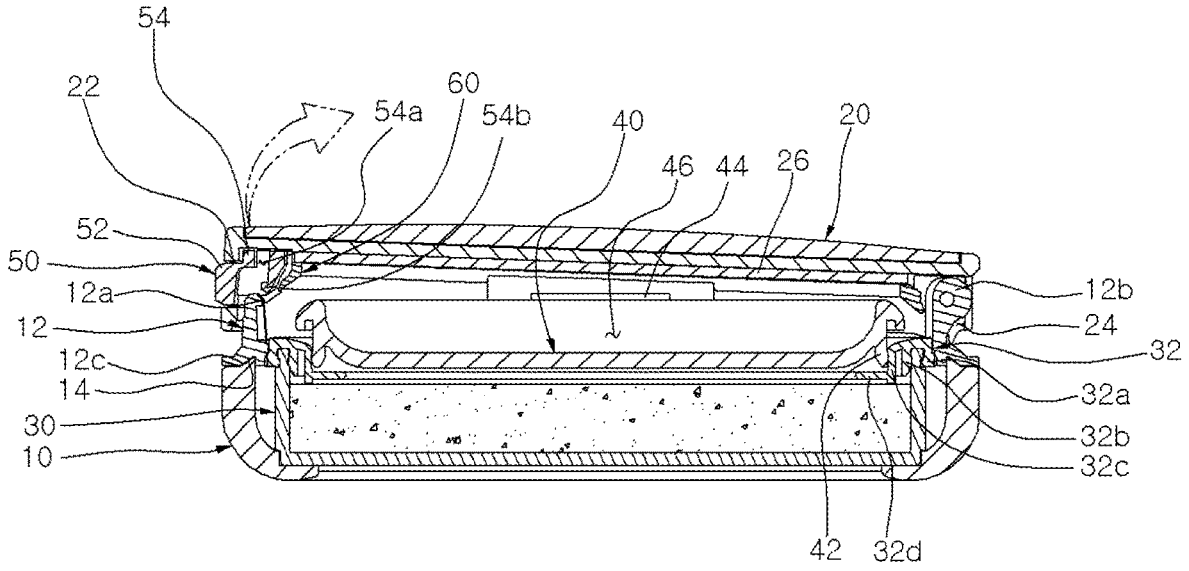
FIG. 6 is a sectional view illustrating a state in which a container lid is rotated to be opened according to one aspect of the present disclosure.
Figure 7:
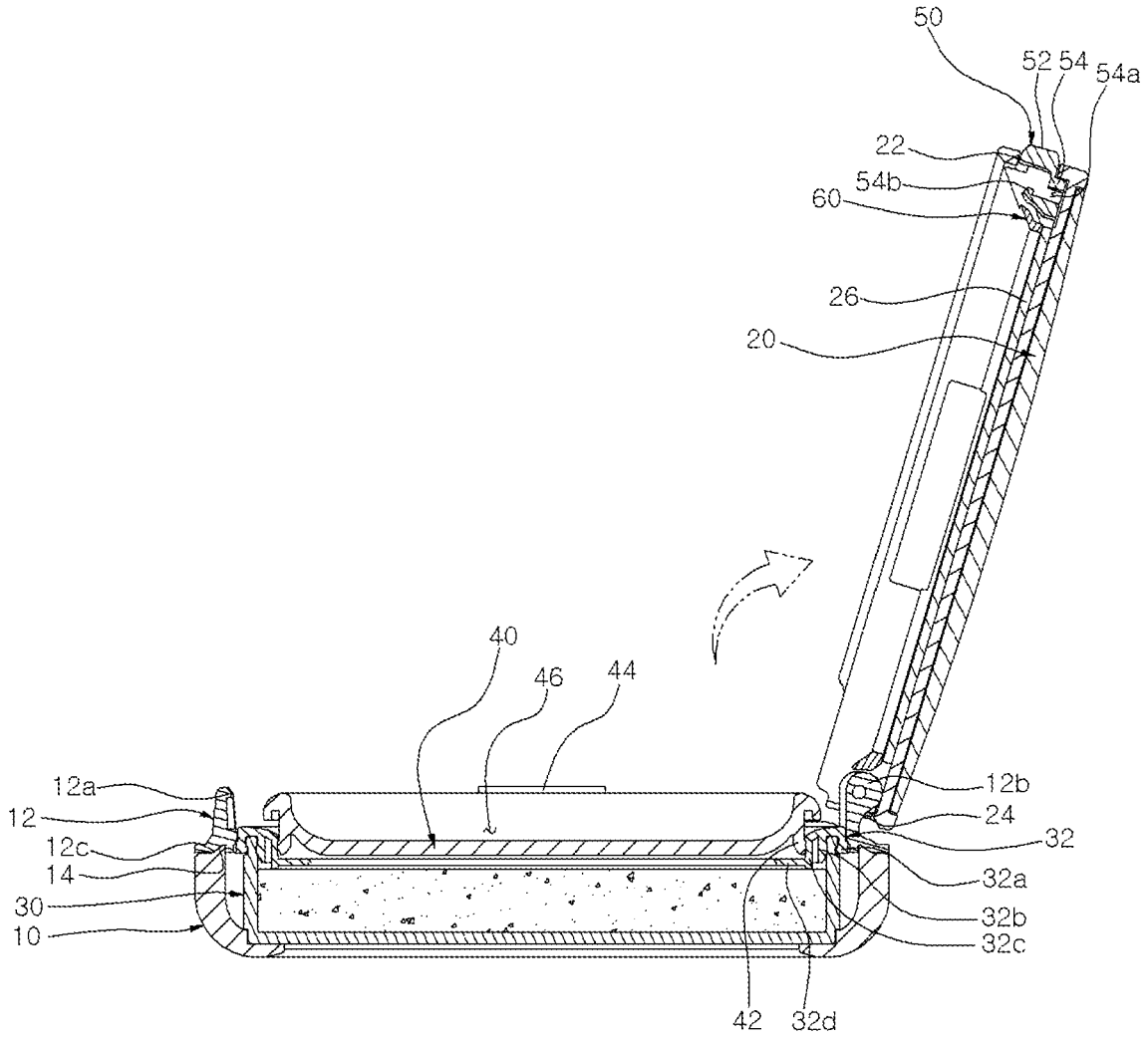
FIG. 7 is a sectional view illustrating a state in which a container lid is rotated to be completely opened according to one aspect of the present disclosure.
Figure 8:
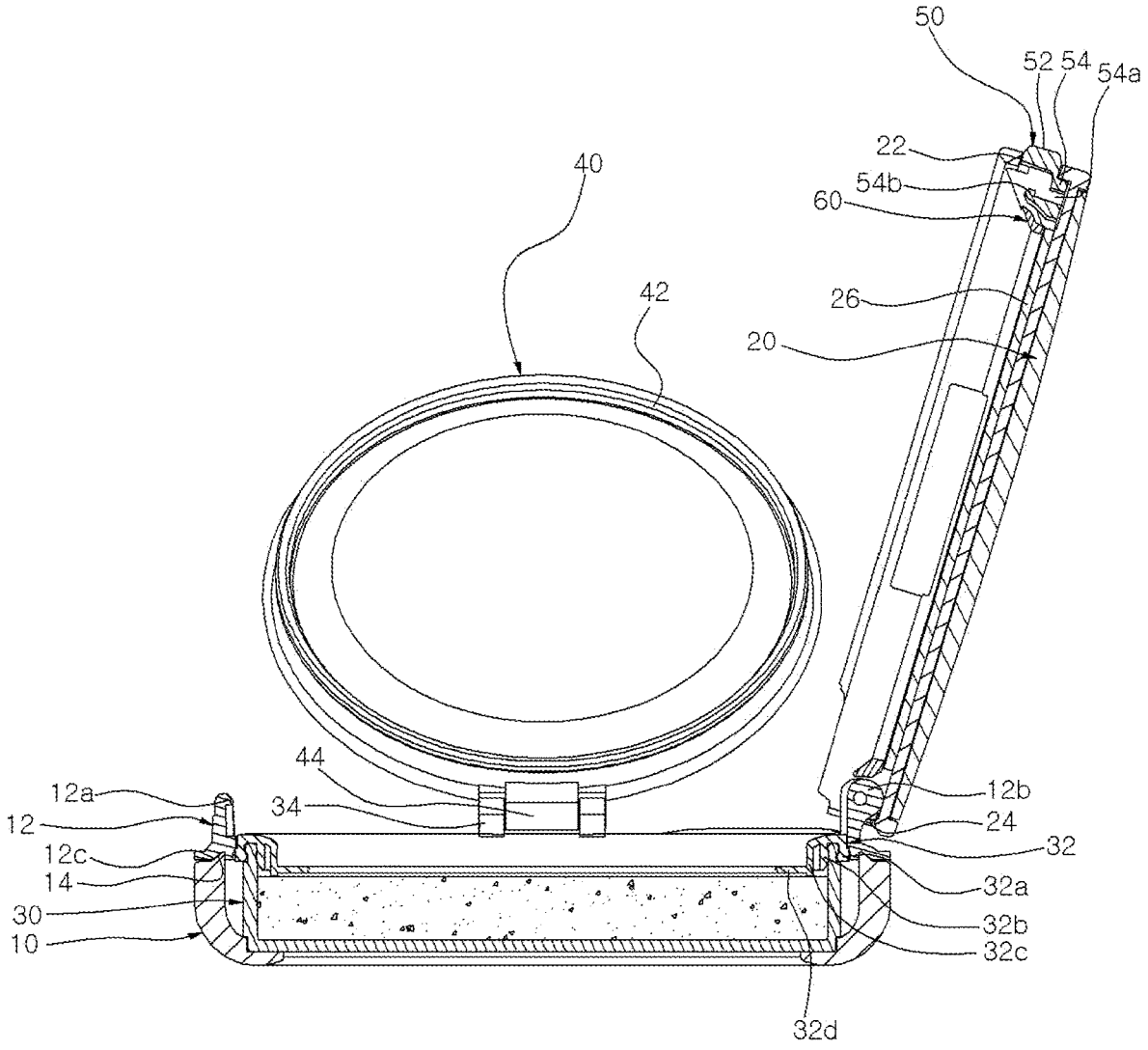
FIG. 8 is a sectional view illustrating a state in which a content container lid is opened according to one aspect of the present disclosure.

FIG. 5 is a sectional view illustrating a state in which a container body is released from a container lid by pressing a push button according to one aspect of the present disclosure, FIG. 6 is a sectional view illustrating a state in which a container lid is rotated to be opened according to one aspect of the present disclosure, FIG. 7 is a sectional view illustrating a state in which a container lid is rotated to be completely opened according to one aspect of the present disclosure, and FIG. 8 is a sectional view illustrating a state in which a content container lid is opened according to one aspect of the present disclosure.

In order to use the cosmetic container according to one aspect of the present disclosure, first, as shown in FIG. 5, the locking state between the container body 10 and the container lid 20 is unlocked by pressing the push button 50 installed on one side of the container lid 20. In this case, as can be understood from a partially enlarged view in FIG. 5, the push button 50 is moved linearly to the inside of the container lid 20 so that the second locking hook 54*b* of the push button 50 is elastically pushed back. At the same time, the second locking hook 54*b* and the first locking hook 12*a* are spaced apart from each other so that the locking state is unlocked.

Thereafter, as shown in FIG. 6, the container lid 20 is opened from the container body 10 by rotatably lifting the container lid 20.

Next, when the container lid 20 is completely opened as shown in FIG. 7, the content container lid 40 is opened from the content container 30 by rotating the content container lid 40 as shown in FIG. 8, and the makeup is performed while dipping the contents contained in the content container 30 with a cosmetic tool such as a puff and spreading the contents on the skin.

After the makeup has been finished, the content container lid and the container lid 20 are rotated to be closed so that the contents are stored and carried. In this case, since the container body 10 and the content container 30 are formed of a transparent material, the contents can be reflected to the outside without opening the container lid 20.

As described above, in the present description, specific matters such as specific components and the like have been described with limited embodiments and drawings, but this is provided only to help a more general understanding of the present disclosure, and the present disclosure is not limited to the above embodiments. Various modifications and variations are possible from the above descriptions by those skilled in the art which the present disclosure pertains.

Therefore, the spirit of the present disclosure is not limited to the described embodiments, and not only the claims appended here, but also equivalent or equivalent modifications to the claims fall within the scope of the inventive concept.

What is claimed is:

1. A cosmetic container with contents visible from an outside, the cosmetic container is characterized by comprising:

a container body provided at one side thereof with a first locking hook and formed of a transparent material;

a container lid for opening and closing the container body;

a content container mounted in the container body, receiving the contents therein, and formed of a transparent material;

a content container lid for opening and closing the content container;

a push button installed on the container lid so as to be press-operated and provided with a second locking hook; and a button coupling member coupled to an inside of the container lid to fix the push button and hingedly coupled to the container body, wherein a button insertion hole is formed in the button coupling member such that at least a portion of the push button is inserted into the button insertion hole, and a second hinge portion is formed on the button coupling member and hingedly coupled with the first hinge portion formed on the container body.

2. The cosmetic container of claim 1, wherein a body coupling ring having the first locking hook and a first hinge portion is coupled to the container body, and the body coupling ring is bonded to an upper end of the container body.

3. The cosmetic container of claim 1, wherein a button through hole is formed in one side of the container lid, and at least a portion of the push button passes through the button through hole.

4. The cosmetic container of claim 1, wherein a mirror is formed on an inside of the container lid, the button coupling member has a ring shape with a predetermined width, and the button coupling member is coupled to an inside of the container lid while pressing an edge portion of the mirror.

5. A cosmetic container with contents visible from an outside, the cosmetic container is characterized by comprising:

a container body provided at one side thereof with a first locking hook and formed of a transparent material;

a container lid for opening and closing the container body;

a content container mounted in the container body, receiving the contents therein, and formed of a transparent material;

a content container lid for opening and closing the content container;

a push button installed on the container lid so as to be press-operated and provided with a second locking hook; and a button coupling member coupled to an inside of the container lid to fix the push button and hingedly coupled to the container body, wherein the push button includes a push portion exposed to an outside of the container lid, a locking portion inserted into an inside of the container lid and having a hook insertion hole and the second locking hook, and elastic blades extending both sides of the locking portion to provide elasticity to the push portion and the locking portion.

6. A cosmetic container with contents visible from an outside, the cosmetic container is characterized by comprising:

a container body provided at one side thereof with a first locking hook and formed of a transparent material;

a container lid for opening and closing the container body;

a content container mounted in the container body, receiving the contents therein, and formed of a transparent material;

a content container lid for opening and closing the content container;

a push button installed on the container lid so as to be press-operated and provided with a second locking hook; and a button coupling member coupled to an inside of the container lid to fix the push button and hingedly coupled to the container body, wherein a content container coupling ring is coupled to an upper end of the content container, first and second lower extension protrusion rings that are coupled while surrounding an upper end of an outer wall of the content container extend from a lower side of the content container coupling ring, and a third lower extension protrusion ring is provided in close contact with a sealing protrusion ring formed on the content container lid while being inwardly spaced from the first and second lower extension protrusion rings.

* * * * *